US008834194B2

(12) United States Patent
Sakai

(10) Patent No.: US 8,834,194 B2
(45) Date of Patent: Sep. 16, 2014

(54) LED SOCKET HAVING A HOUSING WITH A SECURING MEMBER AND A LED MODULE RECEIVING PORTION

(75) Inventor: Ken Sakai, Tokyo (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 44 days.

(21) Appl. No.: 13/613,609

(22) Filed: Sep. 13, 2012

(65) Prior Publication Data

US 2013/0065419 A1 Mar. 14, 2013

(30) Foreign Application Priority Data

Sep. 13, 2011 (JP) ..... 2011-199906

(51) Int. Cl.

| | |
|---|---|
| ***H01R 13/625*** | (2006.01) |
| ***F21V 19/00*** | (2006.01) |
| ***H01R 12/51*** | (2011.01) |
| ***F21V 29/00*** | (2006.01) |
| *F21Y 101/02* | (2006.01) |

(52) U.S. Cl.

CPC ..... *F21V 29/22* (2013.01); *F21V 19/004* (2013.01); *F21V 19/0055* (2013.01); *H01R 12/515* (2013.01); *F21Y 2101/02* (2013.01)

USPC ..... 439/345

(58) Field of Classification Search

USPC ..... 439/345, 370, 56, 441, 489–490

See application file for complete search history.

(56) References Cited

U.S. PATENT DOCUMENTS

| | | | | |
|---|---|---|---|---|
| 7,540,761 | B2 | 6/2009 | Weber et al. | |
| 7,611,376 | B2 * | 11/2009 | Daily et al. | 439/419 |
| 7,828,557 | B2 | 11/2010 | Vogt et al. | |
| 7,976,355 | B2 * | 7/2011 | McAnulty | 446/46 |
| 8,192,226 | B2 * | 6/2012 | Keswani et al. | 439/441 |
| 8,241,044 | B2 | 8/2012 | Mostoller et al. | |
| 2009/0130889 | A1 * | 5/2009 | Daily et al. | 439/345 |
| 2011/0038147 | A1 | 2/2011 | Lin et al. | |
| 2011/0076900 | A1 * | 3/2011 | Keswani et al. | 439/787 |
| 2011/0117785 | A1 * | 5/2011 | Takata | 439/628 |
| 2012/0156920 | A1 * | 6/2012 | Sakai et al. | 439/387 |

FOREIGN PATENT DOCUMENTS

| | | | |
|---|---|---|---|
| EP | 2322852 | A1 | 5/2011 |
| JP | 2009-176733 | A | 8/2009 |

OTHER PUBLICATIONS

European Search Report, dated Feb. 6, 2013, 6 pages.

* cited by examiner

*Primary Examiner* — Chandrika Prasad
(74) *Attorney, Agent, or Firm* — Barley Snyder

(57) ABSTRACT

An LED socket is provided for accommodating an LED module and connecting to a heat sink. The LED socket includes a socket housing and a contact. The socket housing includes an LED module receiving portion and a first LED module securing member projecting downward from a bottom surface of the LED module receiving portion. The contact includes a securing portion securable with the socket housing, a wire connecting portion extending from the securing portion and received by the socket housing, and a contact portion insertable into the socket housing and projecting into the LED module receiving portion.

31 Claims, 10 Drawing Sheets

LED SOCKET HAVING A HOUSING WITH A SECURING MEMBER AND A LED MODULE RECEIVING PORTION

CROSS-REFERENCE TO RELATED APPLICATIONS

This application claims the benefit of the filing date under 35 U.S.C. §119(a)-(d) of JP Patent Application No. 2011-199906 of Sep. 13, 2011.

FIELD OF THE INVENTION

The invention relates to an LED socket and, in particular, to an LED socket for supplying the power to an LED module.

SUMMARY

Conventionally, lighting equipment using LED technology is known. In known LED lighting equipment, for example, an LED module in which an LED chip is mounted onto a board is used. In this LED module, supplying of the power to the LED chip on the board is necessary. Conventionally, in order to supply power to the LED chip, contacts may be provided for elastically making contact with electrodes on the board connected with terminals of the LED chip, so that a connector (a known LED socket) having wire connecting portions for connecting wires connected to the power supply is used for the contacts.

On the other hand, the LED module is generally mounted on a heat sink in order to dissipate heat generated from the LED module. In order to supply the power to the LED chip from the contacts of the connector with certainty, the LED module has to be positioned on the heat sink when mounting the LED module.

An LED lamp includes a connector that enables the positioning of the LED module on the heat sink, a lamp shown in FIG. 11, for example, is known (see JP 2009-176733 A).

The known LED lamp 101 shown in FIG. 11 includes an LED module 120 mounted on a heat sink 150, a connector 110, an optical component holding portion 130, and an optical component 140.

The LED module 120 is formed by mounting an LED chip 122 onto a board 121 having a star shape. Multiple electrodes 123 connected to terminal portions of the LED chip 122 are arranged on the board 121. Multiple notches 124 are formed at the outer edge of the board 121.

Moreover, the connector 110 is mounted on top of the LED module 120, which is mounted on the heat sink 150, and includes a housing 111 having an annular shape, and two contacts, not illustrated, accommodated in the housing 111. A LED chip receiving section 112 for accommodating the LED chip 122 therein is formed at the center of the housing 111 in the embodiment shown. Positioning projections 113 are formed on the housing 111 and project from corresponding to some of the multiple notches 124 formed in the board 121. Additionally, positioning notches 114 are also formed in the housing 111 at positions corresponding to the others of the multiple notches 124 formed in the board 121. Note that electrical wires W, which are connected to a power supply (not illustrated), are connected to the respective contacts.

When assembling the LED lamp 101, the LED module 120 is firstly arranged on the heat sink 150 such that some of the notches 124 of the board 121 are aligned with hole 151 of the heat sink 150.

Next, the connector 110 is placed on the LED module 120. At this time, the positioning projections 113 of the connector 110 are fit into the corresponding notches 124 of the multiple notches 124 formed in the board 121. This positions the connector 110 onto the LED module 120. Accordingly, elastic contact portions of the contacts provided on the connector 110 are brought into contact at proper positions of the electrodes formed on the board 121 with certainty. Moreover, when the positioning projections 113 of the connector 110 are fit into the corresponding notches 124 of the multiple notches 124, the positioning notches 114 of the connector 110 are aligned with the corresponding notches 124 of the multiple notches 124.

Fasteners 160 are screwed into fastener receiving passageways 151 of the heat sink 150 through the positioning notches 114 and the notches 124 aligned with each other. This makes head portions of the fasteners 160 sandwich and hold the connector 110 and the board 121 of the LED module 120 between the head portions themselves and the heat sink 150. Accordingly, the connector 110 and the LED module 120 are positioned and secured onto the heat sink 150.

Subsequently, the optical component holding portion 130 is mounted onto the connector 110, and the optical component 140 is positioned on the optical component holding portion 130. This completes the conventional LED lamp 101.

However, this conventional LED lamp 101 has the following problems.

That is, the board 121 of the LED module 120 used for the LED lamp 101 is made of aluminum for favorable thermal conductivity. Therefore, multiple notches 124 can be formed in the board 121 relatively cheaply by machining, such as cutting.

Meanwhile, in these years, boards used for LED modules are made of a ceramic. However, when the board is made of a ceramic, it is difficult to form something like the aforementioned notches 124 through machining, such as cutting. Assuming the case of forming the notches in a ceramic board, there is a problem that the cost is extremely high.

SUMMARY

Accordingly, the present invention has been made to solve the above problems, and has an object to provide an LED socket for accommodating to an LED module and connecting to a heat sink. The LED socket includes a socket housing and a contact. The socket housing includes an LED module receiving portion and a first LED module securing member projecting downward from a bottom surface of the LED module receiving portion. The contact includes a securing portion securable with the socket housing, a wire connecting portion extending from the securing portion and received by the socket housing, and a contact portion insertable into the socket housing and projecting into the LED module receiving portion.

BRIEF DESCRIPTION OF THE DRAWING(S)

The features and advantages of the invention should become apparent from the following description when taken in conjunction with the accompanying drawings, in which.

DETAILED DESCRIPTION OF THE EMBODIMENT(S)

Embodiments of the present invention will now be described with reference to the drawings.

Figure 4:
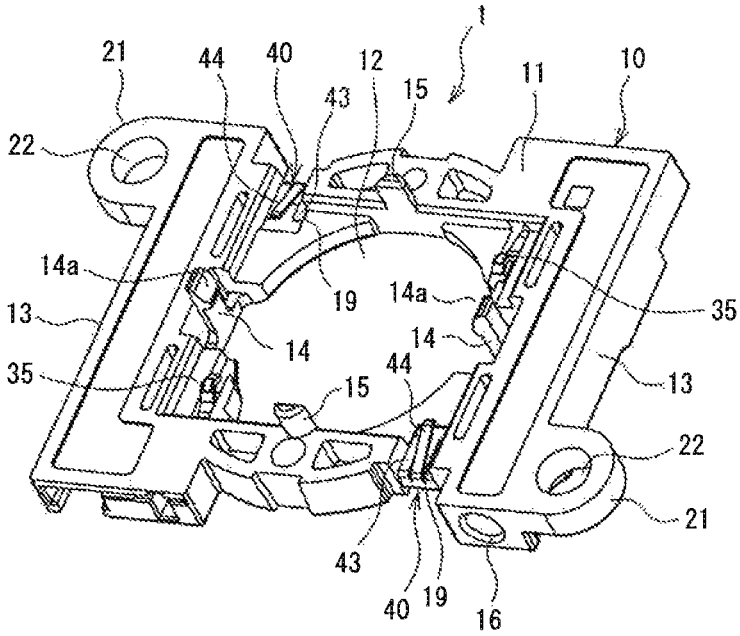
FIG. 4 is a perspective view of the LED socket shown in FIG. 1 when viewed from a bottom side.
Figure 5:
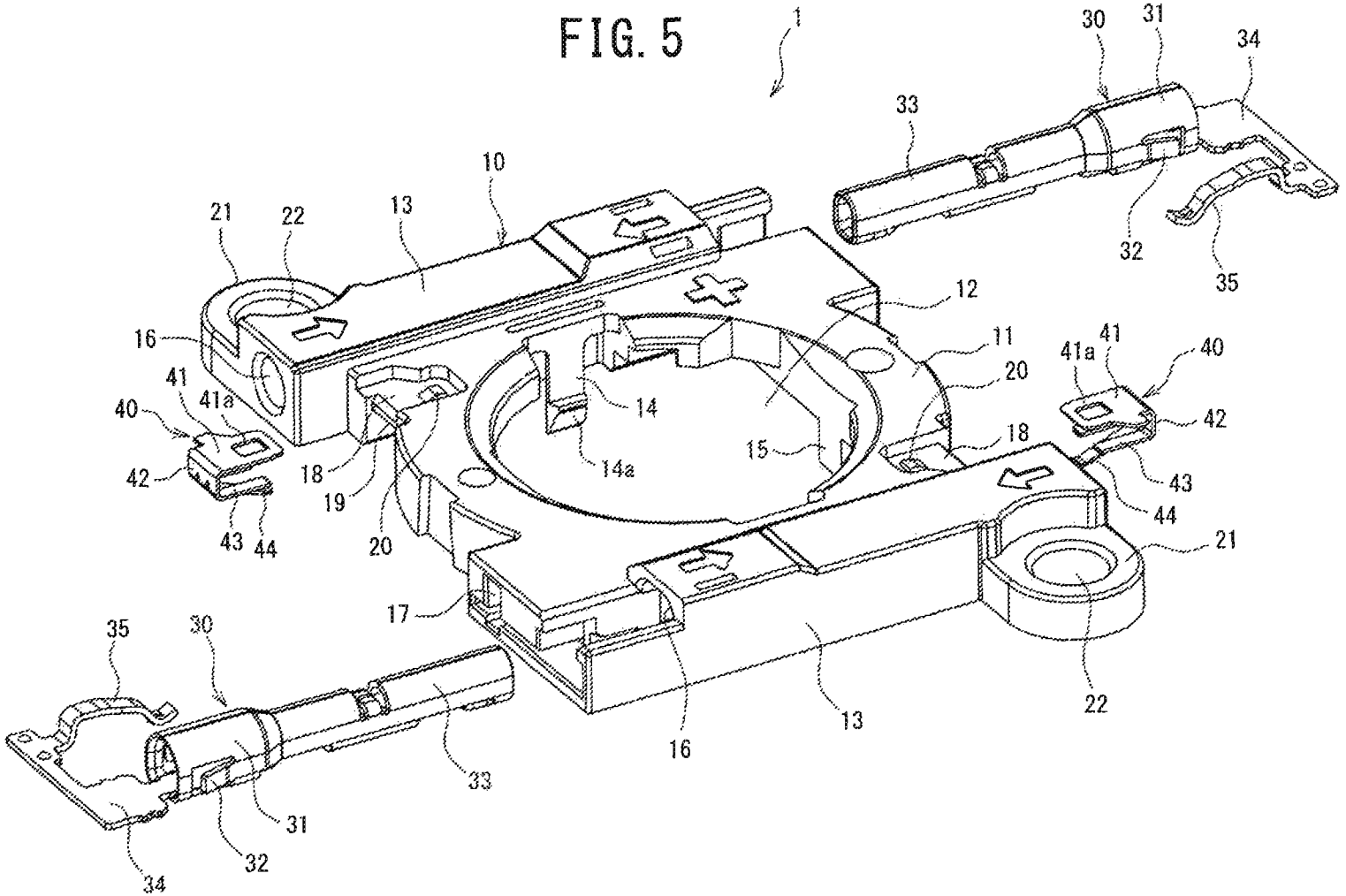
FIG. 5 is an exploded perspective view of the LED socket shown in FIG. 1.
Figure 6:
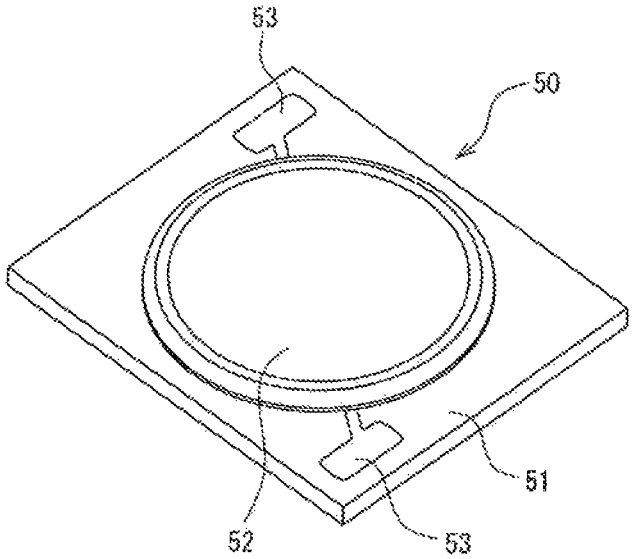
FIG. 6 is a perspective view of an LED module of the LED socket show in FIG. 1.

In FIG. 1 to FIG. 5, an LED socket 1 according to the invention is provided for supplying the power to an LED module 50 having an LED chip 52 mounted on a board 51, as shown in FIG. 6. The LED module 50 according to the invention, as shown in FIG. 6, includes the board 51 having a substantially rectangular shape, and the LED chip 52 mounted on the board 51. Two electrodes 53 connected to terminal portions (not illustrated) of the LED chip 52 are provided on the board 51. The board 51 is made of ceramic, for example.

The LED socket 1 is then mounted onto a heat sink 60 after retaining the LED module 50.

In this case, the LED socket 1 includes a socket housing 10 to be mounted onto the heat sink 60, two contacts 30 attached to the socket housing 10, and two spring members 40.

Figure 9:
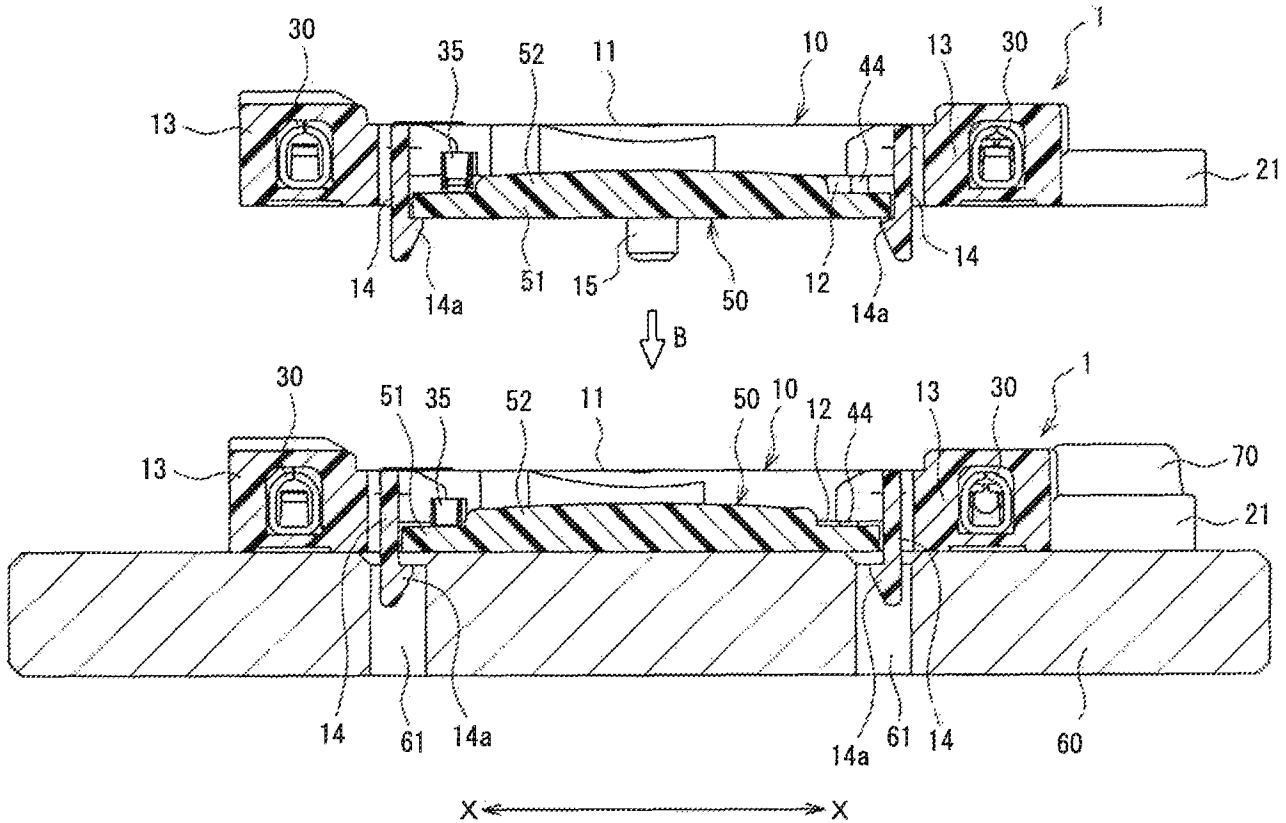
FIG. 9 is a diagram and sectional view of the LED socket according to the invention, taken along line 9-9 in FIG. 8.
Figure 10:
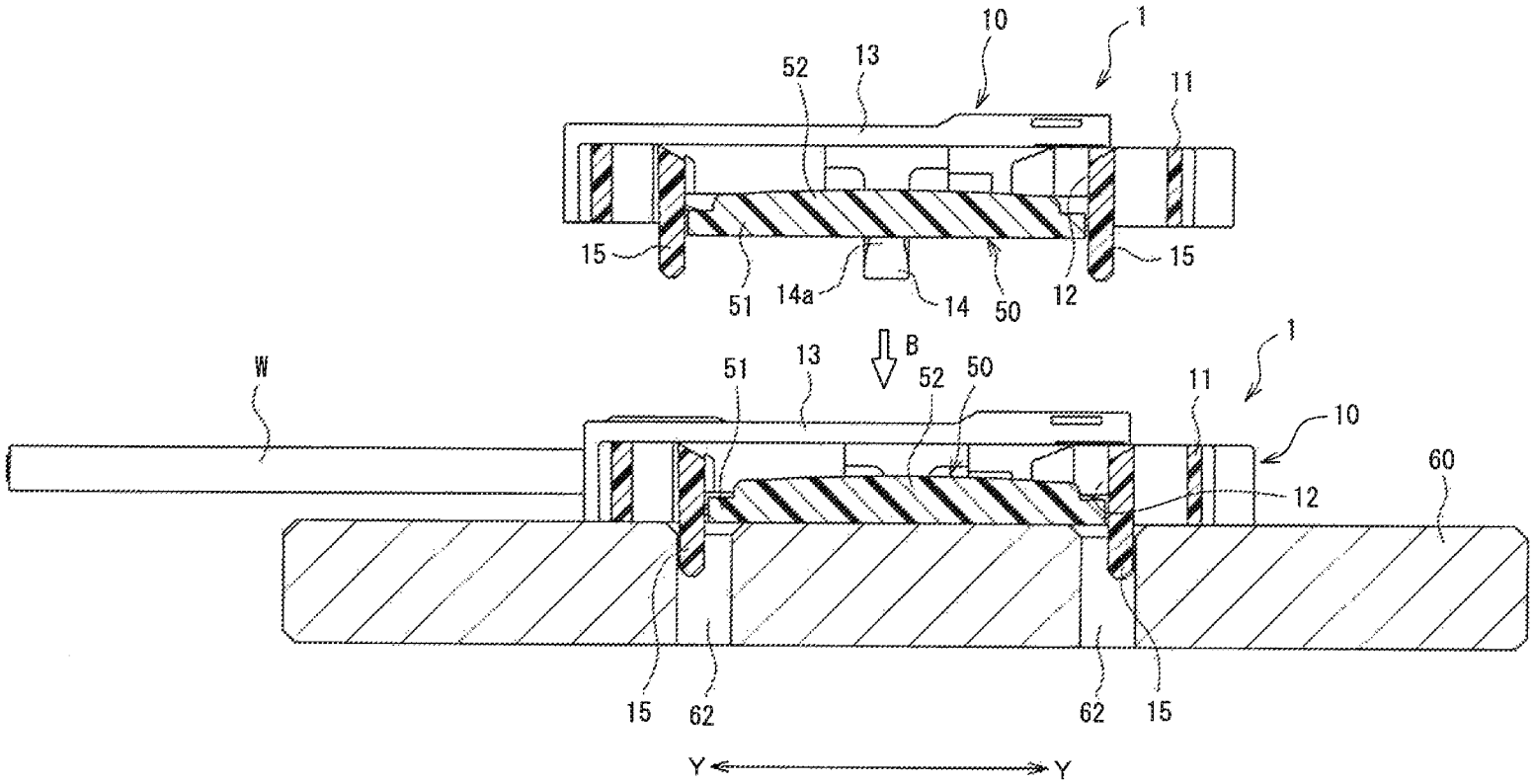
FIG. 10 is a sectional view of the LED socket according to the invention, taken along line 10-10 in FIG. 8.
Figure 11:
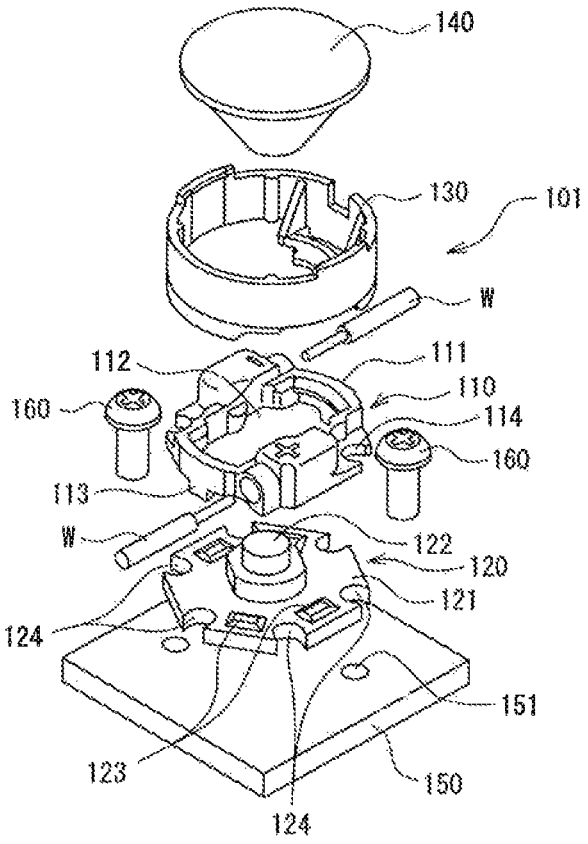
FIG. 11 PRIOR ART
FIG. 11 is an exploded perspective view of a conventional LED lamp.

The socket housing 10, as shown in FIG. 1 to FIG. 5, includes an LED module receiving portion 11 formed in a substantially rectangular shape, in the embodiment shown, to extend in the lateral direction (indicated by an arrow X in FIG. 9) and in the longitudinal direction (direction indicated by an arrow Y in FIG. 10). A pair of contact accommodating passageways 13 are provided on both side portions of the LED module receiving portion 11. In the shown embodiment, the socket housing 10 is formed by molding insulating synthetic resin.

Figure 2:
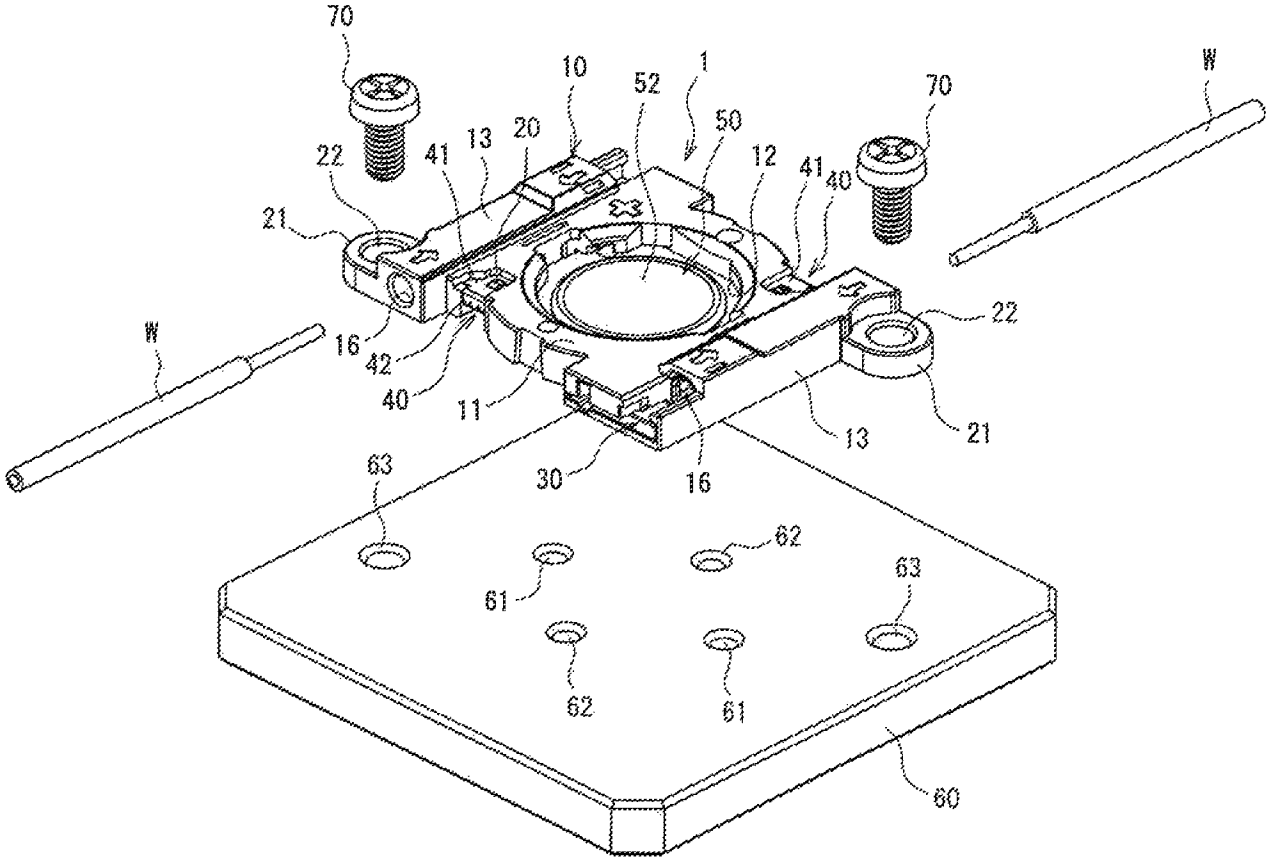
FIG. 2 is an exploded perspective view of the LED socket shown in FIG. 1.
Figure 3:
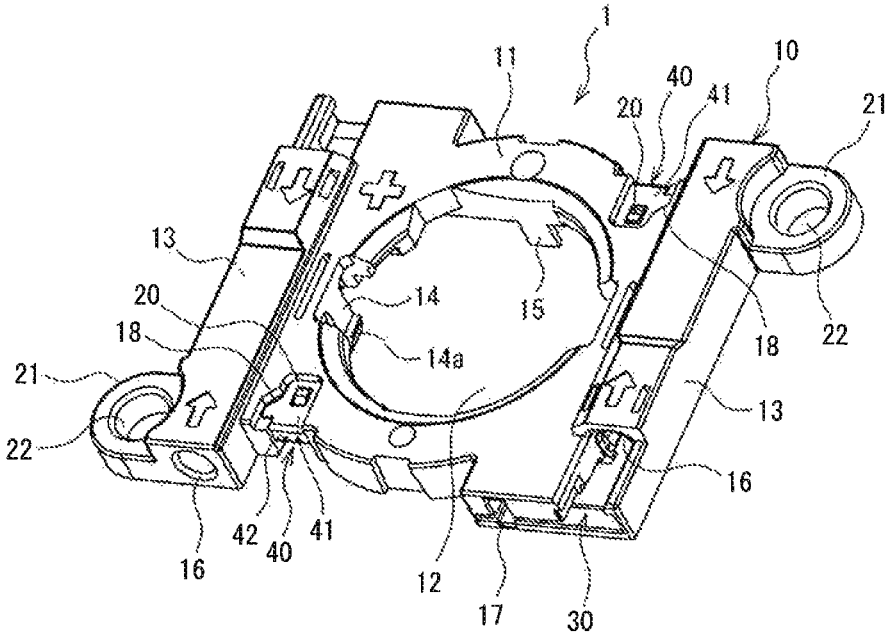
FIG. 3 is a perspective view of the LED socket shown in FIG. 1 when viewed from a top side.
Figure 7:
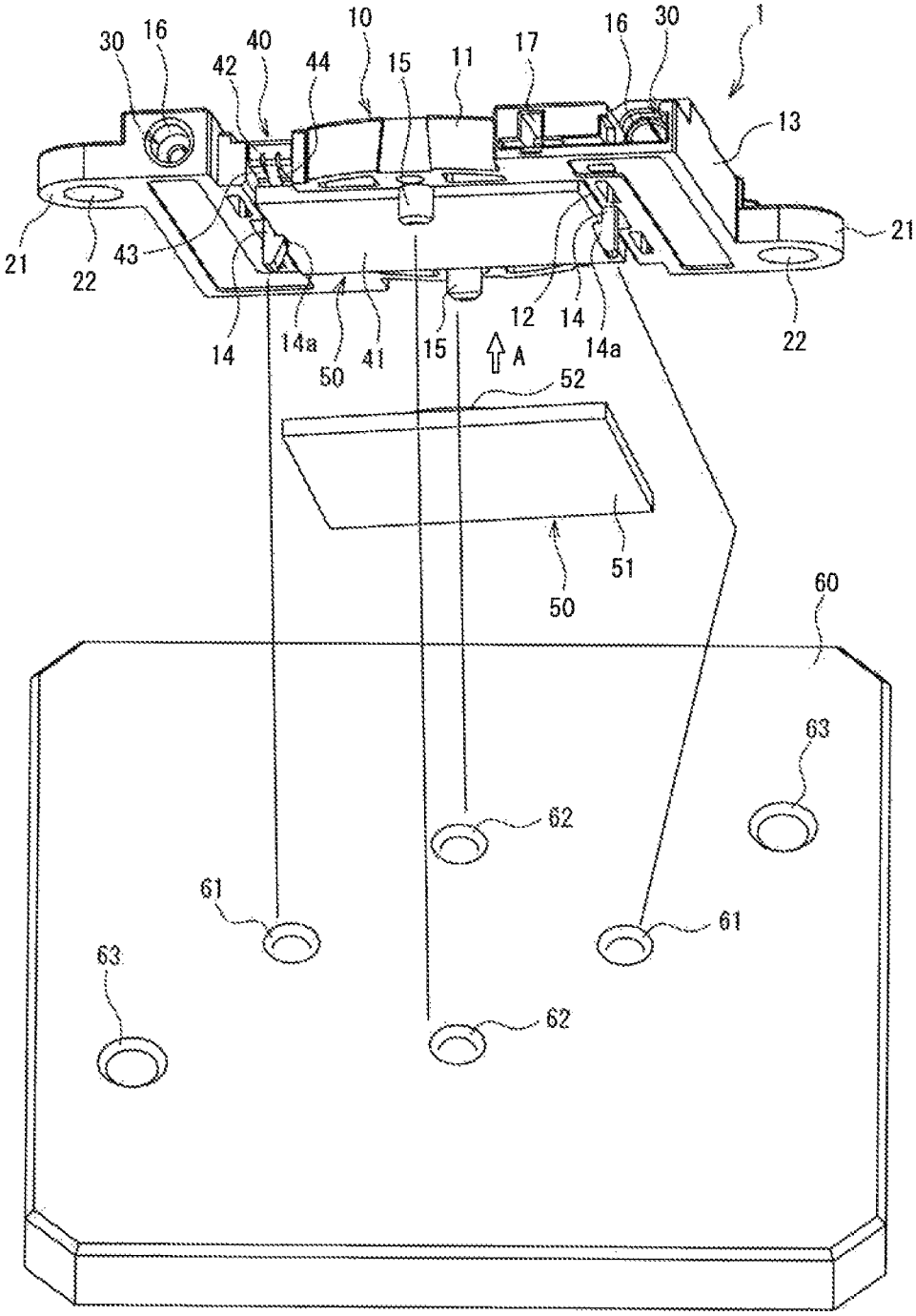
FIG. 7 is a diagram showing an exemplary assembly of the LED module and the LED socket according to the invention, onto a heat sink.

An LED module accommodating space 12 for accommodating the LED module 50 therein is formed substantially at the center of the LED module receiving portion 11, in the shown embodiment, when viewed from above. The LED module accommodating space 12 penetrates between the top surface and the bottom surface of the LED module receiving portion 11. As shown in FIG. 4 and FIG. 7, a portion open from the bottom surface side of the LED module receiving portion 11 is formed in the LED module accommodating space 12, and to have a substantially rectangular shape to correspond to the shape of the board 51 of the LED module 50. This substantially restricts movement of the LED module 50 received in the LED module accommodating space 12 along the lateral direction (designated by X direction in FIG. 9) and in the longitudinal direction (designated by Y direction in FIG. 10) of the socket housing 10. A portion of the LED module accommodating space 12, open from the top surface side of the LED module receiving portion 11, includes a substantially circular shape to accommodate the LED chip 52 of the LED module 50, as shown in FIG. 1 to FIG. 5.

Figure 1:
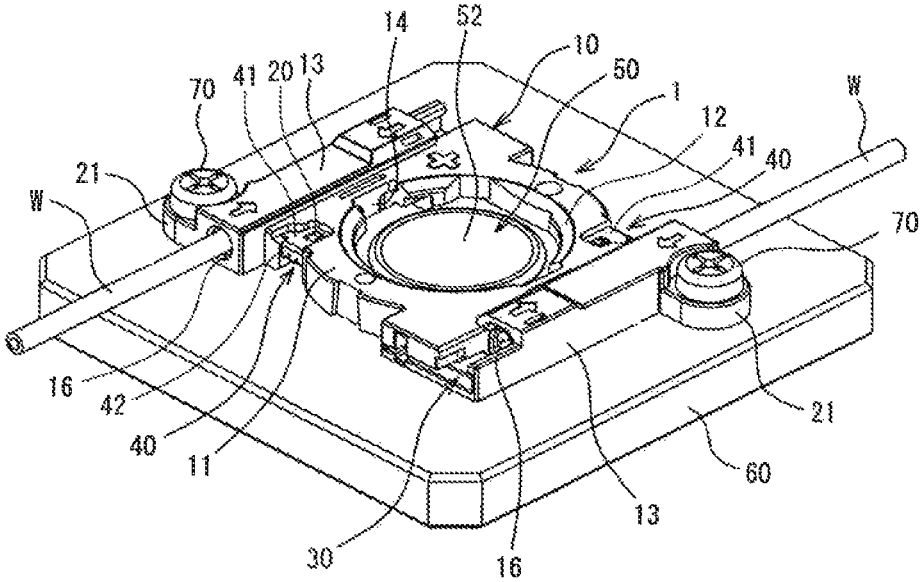
FIG. 1 is a perspective view of an LED socket according to the invention.
Figure 8:
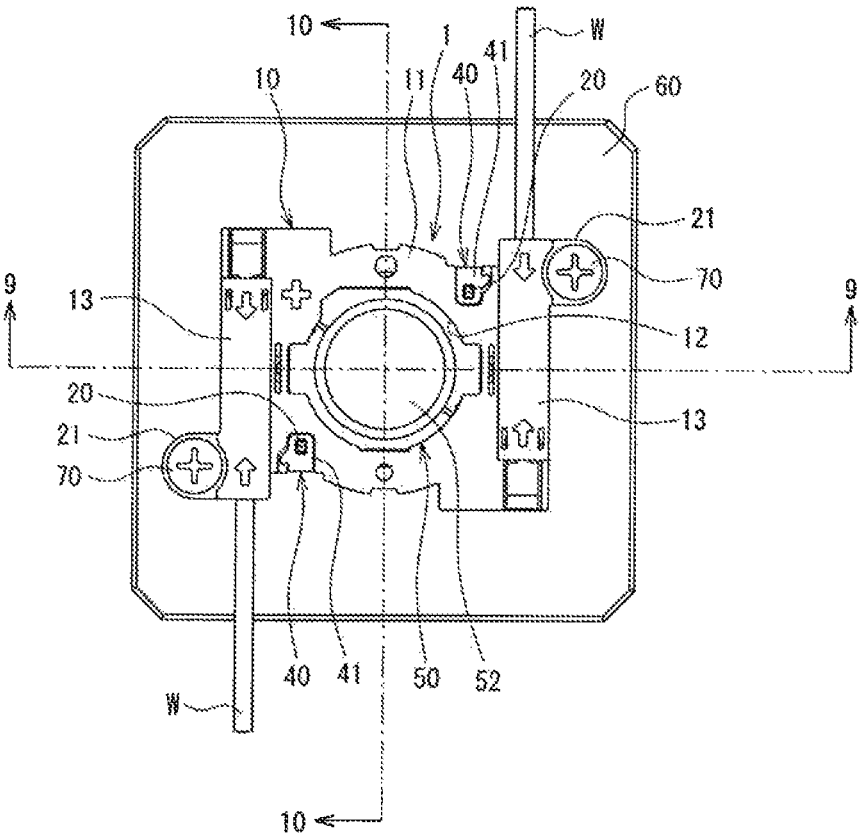
FIG. 8 is a plan view of the LED socket shown in FIG. 1, retaining the LED module and secured to the heat sink.

Moreover, the pair of contact accommodating passageways 13 are arranged symmetrically with respect to the center point of the LED module receiving portion 11, when viewed from above. Each of the contact accommodating passageways 13 has a contact receiving space 16 open at bath end portions in the longitudinal direction. In the shown embodiment, the contact receiving space 16 in the contact accommodating passageway 13 arranged on the left side portion of the LED module receiving portion 11 receives a contact 30 from the back end portion, as shown in FIG. 5. The contact receiving space 16 then receives an electrical wire W from the front end portion in the longitudinal direction, as shown in FIG. 1, FIG. 2, and FIG. 8. On the other hand, the contact receiving space 16 of the contact accommodating passageway 13 arranged on the right side portion in the lateral direction of the LED module receiving portion 11 receives a contact 30 from the front end portion, as shown in FIG. 5. The contact receiving space 16 then receives an electrical wire W from the back end portion in the longitudinal direction, as shown in FIG. 1, FIG. 2, and FIG. 8. In addition, a contact portion receiving passageway 17 into which a contact portion 35 of the contact 30 is inserted is provided in the LED module receiving portion 11 adjacent to the side of the contact accommodating passageway 13 that receives the contact 30, as shown in FIG. 3 and FIG. 5. Each contact portion receiving passageway 17 penetrates from an end wall of the LED module receiving portions 11 toward the LED module accommodating space 12.

In addition, an upper-side spring member accommodating recess 18 and a lower-side spring member accommodating recess 19, each for receiving a spring member 40, are provided in the LED module receiving portion 11 adjacent to the side of the contact accommodating passageway 13 that receives the electrical wires W, as shown in FIG. 1 to FIG. 5. The upper-side spring member accommodating recess 18 extends from the end wall of the LED module receiving portion 11 to the center to recede from the top surface thereof. Moreover, the lower-side spring member accommodating recess 19 extends from the end wall of the LED module receiving portion 11 to the center to recede from the bottom surface thereof. Furthermore, a depression is formed along the end wall of the LED module receiving portion 11 that connects the upper-side spring member accommodating recess 18 and the lower-side spring member accommodating recess 19. In addition, a securing member projection 20 for engaging the spring member 40 is formed along each upper-side spring member accommodating recess 18.

Furthermore, in the embodiment shown, a seat 21 is provided and projecting from the pair of contact accommodating passageways 13, as shown in FIG. 1 to FIG. 5. A fastener receiving passageway 22 into which a fastener 70 is inserted is formed in each of the seats 21 to penetrate vertically.

Furthermore, as shown in FIG. 3 to FIG. 5, and FIG. 9, a pair of securing members 14 projecting downward from the bottom surface of the LED module receiving portions 11 are provided on both side portions of the LED module accommodating space 12. Each of the securing members 14 is formed to be elastically deformable, and retains the LED module 50 in the LED module accommodating space 12, as shown in FIG. 9. A projection **14*a* for supporting the bottom surface of the board 51 of the LED module 50 is provided on the lower edge of each of the securing members 14 for retaining the LED module 50** in the embodiment shown.

In addition, a pair of positioning members 15 projecting downward from the bottom surface of the LED module receiving portions 11 are provided on both side portions of the LED module accommodating space 12, as shown in FIG. 3 to FIG. 5, and FIG. 10. An outer surface of each of the positioning members 15 includes an arcuate surface corresponding to a positioning member receiving portion 62 of the heat sink 60 into which the positioning member 15 is inserted, as shown in FIG. 7. This provides each of the positioning members 15 with the ability to position the socket housing 10 (the LED socket 1) onto the heat sink 60, when the LED socket 1 is mounted onto the heat sink 60, as shown in FIG. 10. Moreover, an inner surface of each of the positioning members 15 includes a flat surface corresponding to the outer shape of the board 51 of the LED module 50, as shown in FIG. 3 to FIG. 5, FIG. 7, and FIG. 10. This also provides each of the positioning members 15 the ability guide the insertion of the LED module 50, when the LED module 50 is inserted into the LED module accommodating space 12, as shown in FIG. 7 and FIG. 10. Accordingly, the positioning member 15 constitutes a 'positioning member' as well as a 'guiding portion'.

Furthermore, each contact 30 includes a securing portion 31 to be secured to the contact accommodating passageway 13, when being received in the contact receiving space 16, as shown in FIG. 5. The securing portion 31 has a substantially cylindrical shape in the embodiment shown, and has a contact lance 32 provided on the outer surface thereof. Each contact 30 is also provided with a wire connecting portion 33 extending from one end of the securing portion 31. The wire connecting portion 33 has a substantially cylindrical shape in the embodiment shown, and is connected to an electrical wire W with its insulation layer stripped away. In addition, each contact 30 is also provided with an extension 34 extending from the other end of the securing portion 31 to the contact portion 35, which is positioned parallel to the securing portion 31. In the shown embodiment, the contact portion 35 includes an elastic arm having a cantilever beam shape from the tip of the extension 34, and is brought into elastic contact with an electrode 53 (see FIG. 6) formed on the board 51 of the LED module 50 received in the LED module accommodating space 12. The contact portion 35 is inserted into the contact portion receiving passageway 17, and projects into the LED module accommodating space 12, as shown in FIG. 4. Each contact 30 is made by stamping and forming a conductive metal sheet having spring elasticity.

In addition, each spring member 40 includes an upper flat plate portion 41, a lower flat plate portion 43, and a coupling plate portion 42 for connecting one end of the upper flat plate portion 41 and one end of the lower flat plate portion 43. The upper flat plate portion 41 and the lower flat plate portion 43 are both formed by bending in the same longitudinal direction from the coupling plate portion 42. A securing member aperture 41*a* is disposed along the upper flat plate portion 41. Moreover, a cantilever beam-shaped elastic arm 44 is cut and extending upward from the lower flat plate portion 43, such that the cantilever beam-shaped elastic arm 44 is inclined. Each spring member 40 is made by stamping and forming a metal sheet. Each spring member 40 is attached to the LED module receiving portion 11, and at that time, the upper flat plate portion 41 is received in the upper-side spring member accommodating recess 18. Moreover, the lower flat plate portion 43 is received in the lower-side spring member accommodating recess 19. Furthermore, the coupling plate portion 42 is received in the depression that connects the upper-side spring member accommodating recess 18 and the lower-side spring member accommodating recess 19. The securing member projection 20 then enters the securing member aperture 41*a* of each spring member 40, so that each spring member 40 is secured to the LED module receiving portion 11. Each spring member 40 is attached to the LED module receiving portion 11, and then the elastic arm 44 is positioned within the LED module accommodating space 12, as shown in FIG. 4. Each elastic arm 44 presses the board 51 down, as shown in FIG. 9. Therefore, when the LED socket 1 is mounted onto the heat sink 60, as shown in FIG. 9, each elastic arm 44 presses the board 51 of the LED module 50 toward the heat sink 60.

A method for assembling the LED socket 1 according to the invention will be described.

Initially, each spring member 40 is attached to the LED module receiving portion 11 as mentioned before.

Then, one contact 30 is accommodated and secured in the contact receiving space 16 of the contact accommodating passageway 13, which is arranged on the left side portion of the LED module receiving portion 11, as shown in FIG. 5. At this time, the contact 30 is inserted into the contact receiving space 16 with the wire connecting portion 33 of the contact 30 positioned at the front. In addition, the other contact 30 is then accommodated and secured in the contact receiving space 16 of the contact accommodating passageway 13, which is arranged on the right side portion of the LED module receiving portion 11, as shown in FIG. 5. At this time, the contact 30 is inserted into the contact receiving space 16 with the wire connecting portion 33 set at the front. This completes the LED socket 1.

Next, a method for mounting the LED module 50 and the LED socket 1 onto the heat sink 60 will be described with reference to FIG. 7 to FIG. 10.

In the embodiment shown in FIG. 7, the heat sink 60 is made of aluminum and includes a substantially flat-plate shape. A pair of securing member passageways 61 are formed in the heat sink 60, at positions corresponding to the pair of securing members 14 of the LED socket 1, respectively, as shown in FIG. 7. Each of the securing member passageways 61 penetrates vertically through the heat sink 60. Further, two positioning member receiving portions 62 are formed at positions corresponding to the pair of positioning members 15 of the LED socket 1, respectively, in the heat sink 60. Each of the positioning member receiving portions 62 also penetrates vertically through the heat sink 60, as shown in FIG. 10. Moreover, two fastener receiving passageways 63 are formed at positions corresponding to the pair of fastener receiving passageways 22 of the LED socket 1, respectively, in the heat sink 60.

When the LED module 50 and the LED socket 1 are mounted on the heat sink 60, the LED module 50 is firstly inserted into the LED module accommodating space 12 of the LED socket 1 upward as indicated by an arrow A, as shown in FIG. 7. Accordingly, the pair of securing members 14 secure the LED module 50, as shown on the upper side of FIG. 9. At this time, the pair of securing members 14 retain the side edges of the board 51 of the LED module 50. Since the LED module 50 is supported by the projections 14*a* of the securing members 14 due to its own weight, the LED module 50 is partially accommodated in the LED module accommodating space 12. This substantially restricts the movement of the LED module 50 (in the X direction in FIG. 9 and the Y direction in FIG. 10) in the socket housing 10. Therefore, even if processing such as notching is not carried out on the board 51 made of ceramic, the LED module 50 can be positioned on the LED socket 1. Even if the board 51 of the LED module 50 is made of any material having rigidity, regardless of ceramic or aluminum, the LED module 50 can be positioned on the LED socket 1.

When the LED module 50 is inserted into the LED module accommodating space 12, the insertion of the LED module 50 is guided by the inner surfaces, that is, flat surfaces of the pair of positioning members 15.

The LED socket 1 holding the LED module 50 is then mounted onto the heat sink 60, as shown in FIG. 9 and FIG. 10. At this time, the LED socket 1 is moved downward as indicated by an arrow B, so that the respective securing members 14 are inserted into the respective securing member passageways 61 and the respective positioning members 15 are inserted into the respective positioning member receiving portions 62. Then, as shown in FIG. 9 and FIG. 10, the bottom surface of the LED module 50 abuts against the top surface of the heat sink 60, and then the bottom surface of the LED socket 1 abuts against the top surface of the heat sink 60. Thereby, the LED module 50 is completely accommodated in the LED module accommodating space 12, as shown on the lower side in FIG. 9 and FIG. 10. The restricted movement of the LED module 50 in the socket housing 10 continues. The insertion of the respective securing members 14 and the respective positioning members 15 into the respective securing member passageways 61 and the positioning member receiving portions 62, respectively, advances.

In this position, the outer surface of each positioning member 15 is positioned along an inner wall surface of each positioning member receiving portion 62 (formed as a circular hole in the embodiment shown). Therefore, each positioning member 15 permits positioning of the LED socket 1 and the LED module 50 onto the heat sink 60 (along Y direction), as shown on the lower side of FIG. 10. Moreover, since the outer surface of each positioning member 15 is positioned along the inner wall surface of corresponding positioning member receiving portion 62, positioning of the LED socket 1 and the LED module 50 on the heat sink 6 (along arrow X direction) is also enabled.

Accordingly, when the LED socket 1 is mounted onto the heat sink 60, it is possible to position the LED socket 1 onto the heat sink 60 with certainty.

Meanwhile, each securing member 14 is inserted into each securing member passageway 61 of the heat sink 60 with a minimal gap between the outer surface (along the X direction) and the inner wall of the securing member passageway 61, as shown on the lower side of FIG. 9. Therefore, each of the securing members 14 functions as a movement restricting member rather than functioning as a positioning member for the LED socket 1 onto the heat sink 60, when the LED socket 1 moves along the X direction.

Then, two fasteners 70 are inserted through the fastener receiving passageways 22 of the LED socket 1 and screwed into the fastener receiving passageways 63 of the heat sink 60, respectively. This sandwiches each of the seats 21 of the LED socket 1 between the head of corresponding fastener 70 and the heat sink 60, thereby completing mounting of the LED socket 1 onto the heat sink 60.

In this position, once the LED socket 1 is mounted onto the heat sink 60, the contact portion 35 of each contact 30 of the LED socket 1 is brought into contact with the electrode 53 provided on the board 51 of the LED module 50. Next, since the contact portion 35 is formed as an elastic arm having a cantilever beam shape, the LED module 50 is pressed toward the heat sink 60 by the elastic force of each contact portion 35. Additionally, when the mounting of the LED socket 1 onto the heat sink 60 is completed, as shown in FIG. 9, the elastic arm 44 of each spring member 40 presses the board 51 of the LED module 50 toward the heat sink 60. Accordingly, the LED module 50 is retained on the heat sink 60 by the elastic force of the contact portion 35 of each contact 30 and the elastic force of the elastic arm 44 of each spring member 40. Accordingly, thermal contact between the LED module 50 and the heat sink 60 is ensured, and heat from the LED module is dissipated with certainty.

Subsequently, as shown in FIG. 10, the respective electrical wires W are inserted into the contact receiving spaces 16 from the end portions in the longitudinal direction of the respective contact accommodating passageways 13 to be connected to the wire connecting portions 33 of the respective contacts 30. This allows the power to be supplied to the LED chips 52 via the contact portions 35 of the respective contacts 30 from the respective electrical wires W.

Heretofore, the embodiments of the invention have been described. However, the invention is not limited to them, and various adaptations and modifications to those embodiments may be carried out.

For example, as to the securing members 14 of socket housing 10, the invention is not limited to a pair of the securing members 14. Multiple pairs of securing members, a single securing member, or multiple securing members may be provided, as long as they are capable of retaining the LED module 50.

Moreover, the socket housing 10 is not always provided with the positioning members 15.

Furthermore, the positioning members 15 have a function of positioning the socket housing 10 onto the heat sink 60, and a function of guiding the insertion of the LED module 50, when the LED module 50 is inserted into the LED module accommodating space 12. However, they may have only the function of positioning the socket housing 10 onto the heat sink 60.

Additionally, in the case where the positioning members 15 have only the function of positioning the socket housing 10 onto the heat sink 60, a guiding portion for guiding the insertion of the LED module 50 may be provided separately, when the LED module 50 is inserted into the LED module accommodating space 12.

Moreover, the LED socket 1 may not be always provided with the spring members 40 having the elastic arms 44 for pressing the LED module 50 accommodated in the LED module accommodating space 12 toward the heat sink 60.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. An LED socket comprising:

a socket housing having an LED module receiving portion and a first LED module securing member projecting downward from a bottom surface of the LED module receiving portion; and a contact having a securing portion securable with the socket housing, a wire connecting portion extending from the securing portion and received by the socket housing, and a contact portion insertable into the socket housing and projecting into the LED module receiving portion.

2. The LED socket according to claim 1, further comprising a spring member connectable with the LED module receiving portion.

3. The LED socket according to claim 2, further comprising an LED module accommodating space formed substantially within a center of the LED module receiving portion.

4. The LED socket according to claim 3, wherein the LED module accommodating space penetrates between a top surface and the bottom surface of the LED module receiving portion.

5. The LED socket according to claim 4, wherein the LED module accommodating space includes a LED module board recess.

6. The LED socket according to claim 5, wherein the LED module accommodating space further includes a LED chip accommodating recess.

7. The LED socket according to claim 3, further comprising a pair of contact accommodating passageways disposed on both side portions of the LED module receiving portion.

8. The LED socket according to claim 7, wherein the pair of contact accommodating passageways are arranged symmetrically with respect to a center point of the LED module receiving portion.

9. The LED socket according to claim 7, wherein each of the pair of contact accommodating passageways includes a contact receiving space open at both end portions.

10. The LED socket according to claim 9, wherein the contact receiving space receives the contact from one of the both end portions.

11. The LED socket according to claim 7, further comprising a contact portion receiving passageway disposed along in the LED module receiving portion and positioned adjacent to one of the pair of contact accommodating passageway's.

12. The LED socket according to claim 11, further comprising an upper-side spring member accommodating recess and a lower-side spring member accommodating recess are disposed on the LED module receiving portion and positioned adjacent to another of the pair of contact accommodating passageways.

13. The LED socket according to claim 12, wherein the upper-side spring member accommodating recess extends from an end wall of the LED module receiving portion to the center to recede from the top surface thereof.

14. The LED socket according to claim 13, wherein the lower-side spring member accommodating recess extends from the end wall of the LED module receiving portion to the center to recede from the bottom surface thereof.

15. The LED socket according to claim 14, further comprising a depression disposed along the end wall of the LED module receiving portion and connecting the upper-side spring member accommodating recess and the lower-side spring member accommodating recess.

16. The LED socket according to claim 15, further comprising a securing member projection disposed along the upper-side spring member accommodating recess.

17. The LED socket according to claim 7, wherein the contact portion is inserted into the one of the pair of contact accommodating passageways.

18. The LED socket according to claim 7, wherein the pair of contact accommodating passageways includes a contact portion receiving passageway that penetrates from an end wall of the LED module receiving portion toward the LED module accommodating space.

19. The LED socket according to claim 7, further comprising a seat projecting from one of the pair of contact accommodating passageways.

20. The LED socket according to claim 19, further comprising a fastener receiving passageway formed in the seat to penetrate vertically thereof.

21. The LED socket according to claim 2, wherein the spring member includes an upper flat plate portion, a lower flat plate portion, and a coupling plate portion for connecting one end of the upper flat plate portion and one end of the lower flat plate portion.

22. The LED socket according to claim 21, further comprising a securing member aperture disposed along the upper flat plate portion.

23. The LED socket according to claim 22, further comprising a cantilever beam-shaped elastic arm cut and extending upward from the lower flat plate portion.

24. The LED socket according to claim 1, further comprising a second LED module securing member projecting downward from the bottom surface of the LED module receiving portion.

25. The LED socket according to claim 24, wherein the first and second securing members are provided on opposite side portions of the LED module receiving portion respectively.

26. The LED socket according to claim 1, wherein the first LED module securing member is elastically deformable and includes a projection provided on a lower edge of the first LED module securing member.

27. The LED socket according to claim 1, further comprising a positioning member projecting downward from the bottom surface of the LED module receiving portion and having an outer arcuate surface.

28. The LED socket according to claim 27, wherein an inner surface of the positioning member includes a flat surface.

29. The LED socket according to claim 1, wherein the contact includes an extension extending between and connecting the securing portion and the contact portion.

30. The LED socket according to claim 29, wherein the securing portion is positioned and extends parallel to the contact portion.

31. The LED socket according to claim 30, wherein the contact portion is an elastic cantilever member extending from a tip of the extension.

* * * * *